US005087100A

United States Patent [19]

Bruce

[11] Patent Number: 5,087,100

[45] Date of Patent: Feb. 11, 1992

[54] METHOD OF FRACTURING ROCK OR SIMILAR MATERIAL AND APPARATUS THEREFORE

[76] Inventor: Howard D. Bruce, 1129 Commodore St., Clearwater, Fla. 34615

[21] Appl. No.: 599,022

[22] Filed: Oct. 17, 1990

[51] Int. Cl.[5] ..... E21C 37/06

[52] U.S. Cl. ..... 299/15; 125/40; 299/20

[58] Field of Search ..... 299/14, 15, 16, 20, 299/22, 69; 125/23.01, 40

[56] References Cited

U.S. PATENT DOCUMENTS

| | | | |
|---|---|---|---|
| 99,595 | 2/1870 | Robb | 299/20 |
| 1,631,290 | 6/1927 | Sheedy et al. | 299/15 |
| 3,101,706 | 8/1963 | Pyle et al. | 299/15 X |
| 3,507,540 | 4/1970 | Silverman | 299/15 |
| 3,988,347 | 10/1976 | Denisart et al. | 299/16 |

FOREIGN PATENT DOCUMENTS

| | | | |
|---|---|---|---|
| 3743643 | 7/1989 | Fed. Rep. of Germany | 125/23.01 |
| 623971 | 9/1978 | U.S.S.R. | 299/15 |
| 1421881 | 9/1988 | U.S.S.R. | 299/14 |

*Primary Examiner*—David J. Bagnell
*Attorney, Agent, or Firm*—Shlesinger, Arkwright & Garvey

[57] ABSTRACT

A method of fracturing a hard compact material such as rock or concrete, having a hole pre-drilled in the material area to be fractured which includes inserting a outer slug of solid material into the hole to a bottom thereof, and impacting the outer slug with a force sufficiently large to cause at least a top portion of the slug to transfer the impact to the sides of said hole so as to fracture the surrounding material.

22 Claims, 7 Drawing Sheets

METHOD OF FRACTURING ROCK OR SIMILAR MATERIAL AND APPARATUS THEREFORE

BACKGROUND

The present invention relates to a method and apparatus for fracturing rock or similar material, in a way so as to achieve removal of large pieces of such material.

A conventional method of breaking rock is to drill into the rock and set explosive charges to blast away sections of rock. Aside from the noise, flying rock fragments and debris the drill-and-blast technique is somewhat unpredictable and frequently entails extra cost. Another technique is that of coring which involves drilling a hole in the shape of a cylindrical sleeve and then inserting tools into the sleeve-like opening and by impacting the tools attempting to fracture the central core of solid material. Unfortunately, it is common for the tools to become jammed in the hole or, for the core to break into many small pieces so that removal of the pieces becomes time consuming and inconvenient.

U.S. Pat. No. 99,595 issued Feb. 8, 1870 to Robb discloses a technique of filling a drilled hole with water or other liquids, and then inserting a plunger fitted to work as tightly as possible above the water, and subjecting the plunger to impact forces such as by a hammer blow. The pressure transmission through the liquid imparts force over the side wall and causes fracturing. There is a practical limitation of the latter method due to the need to seal the water at the side wall between the plunger and the hole. Any leaks reduce substantially the pressure developed in the liquid.

U.S. Pat. No. 3,988,037 issued Oct. 26, 1976 discloses a method similar to Robb in that a pre-drilled hole is filled with hydraulic fluid. A piston is then driven into the hole at speeds ranging up to several hundred meters per second by means of a gun to impact the fluid and cause tensile stress cracks in the material by the established pressure. Such techniques are not amenable to non-vertical holes. Moreover, the rapidly moving piston presents a potential hazard to a user.

U.S. Pat. No. 3,507,540 issued to Silverman on Apr. 21, 1970 uses an expandable packer filled with pressurized hydraulic fluid. A circular channel or kerf is drilled and possibly a central hole drilled as well. The packer is inserted into the bottom of the central hole and the fluid pressure increased until the core fractures. Alternatively, a pair of packers may be inserted into the circular channel at diametrically opposite locations and the pressure then increased until fracturing occurs. The Silverman method requires pumps, a tank and piping leading to and from the pump to the packer. In addition, there is a limit as to the forces the walls of the packer can withstand without rupturing.

Accordingly, it is an object of the invention to provide an improved method of and apparatus for fracturing rock. It is a further object of the invention to provide a method of fracturing and removing large pieces of rock or other similar materials. It is yet another object of the invention to provide a method of fracturing rock which is simpler, more reliable and less expensive than predecessor methods.

SUMMARY OF THE INVENTION

According to the invention there is provided a method of fracturing rock and other similar material in which a hole has been pre-drilled in the area to be fractured which includes inserting into the hole, to the bottom thereof, an outer slug of solid material and then impacting the top of the slug with sufficient force so as to fracture the rock.

Preferably, the outer slug and hole are cylindrical and the outer slug has a length approximately equal to the diameter of the hole.

Advantageously, the force of impact is sufficient to exceed the yield point of the outer slug material and cause at least an upper portion of the outer slug to become fluidized.

An annular kerf may be drilled using an annular drill bit which surrounds the central hole with a core of rock prior to insertion of and impacting the top of the outer slug so that upon fracturing at least a substantial portion of the core defined by the kerf and a transverse plane at the bottom of the hole is fractured and free of the underlying formation.

The outer slug material may be a solid malleable material.

A pin may be used to transfer impact to the outer slug. Such a pin extends at least from an opening of the hole down to a top of the outer slug when fully inserted. The pin may be of a material harder than the outer slug and dimensioned to fit into the hole with a diameter not more than 10% less than that of the hole.

An inner slug may be inserted between the outer slug and the bottom of the hole and be of a material softer than that of the outer slug.

In another aspect of the invention there may be provided apparatus for fracturing a hard unitary material such as rock and concrete, having a hole formed in an area of the material to be broken, which includes an outer slug of solid material having an outer surface conforming to the inner surface of the hole, and means for impacting the outer slug when inserted into the hole at a bottom thereof.

Preferably the impacting means includes an elongated pin of material harder than the outer slug and extending from a top of the outer slug to a point exterior of the hole.

The foregoing method and apparatus provides for a reliable, simple and predictable method and apparatus for creating rock fractures. The method and apparatus is a relatively convenient, inexpensive method of excavating rock or concrete in difficult confined locations, of coring such materials and of making large slabs.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION OF THE INVENTION

Figure 1:
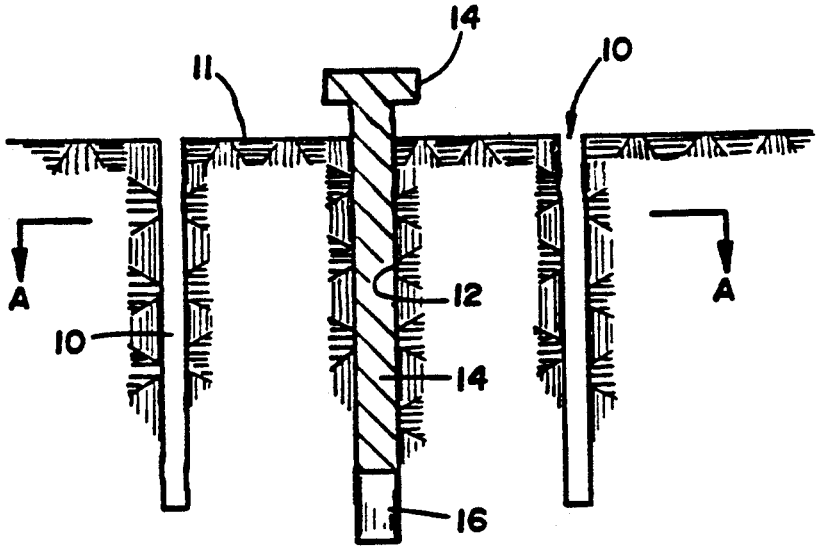
FIG. 1, is a cross-sectional view of a rock formation showing an annular kerf and a central hole with a slug and pin inserted into the hole.
Figure 11:
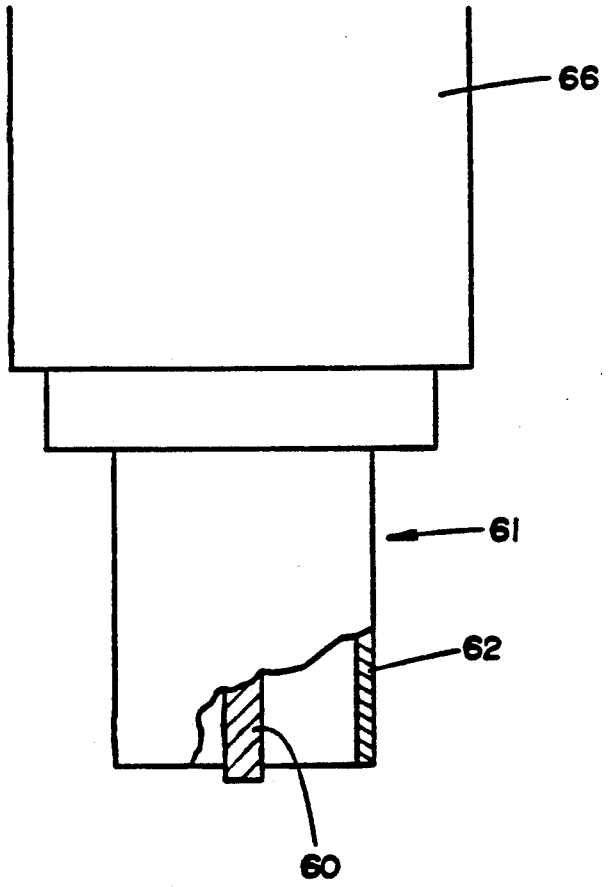
FIG. 11 shows a drill and drill bit having a central drill bit and an annular drill bit.

Referring to FIG. 1 there is shown in cross section a rock formation 11 having an annular kerf 10 and central hole 12 cut into the rock using a drill 66 (FIG. 11) having a drill bit 61 composed of an annular drill bit 62 and a central drill bit 60 where the central drill bit drills to a depth substantially equal to or less than the depth of the kerf 10. A cylindrical slug 16 of aluminum of a length approximately equal to its diameter and of a diameter slightly less than that of the hole 12 is inserted into the hole 12 down to the bottom thereof. It is unimportant whether the slug fits tightly into the hole or not. Next a long pin 14 is inserted into the hole until it contacts the slug 16. The tolerance of the pin 14 is such that its diameter may be 5 to 10% smaller than the diameter of the hole 12.

Figure 2:
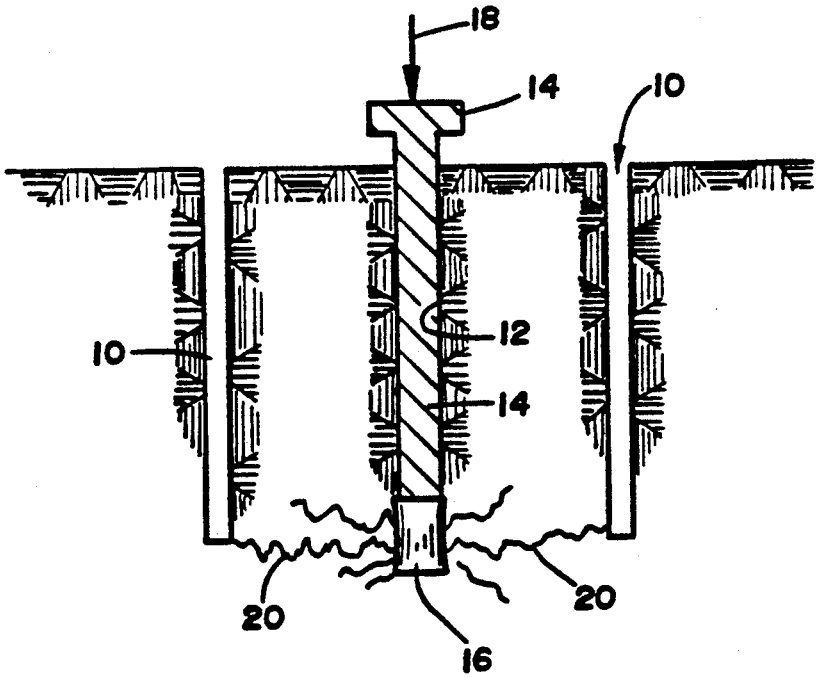
FIG. 2 is a cross-sectional view as in FIG. 1 but following impacting pin with a vertical impact force.

Finally, as shown in FIG. 2 a large impact force is directed vertically down on the top of pin 14 so that it applies an impact force to slug 16 which exceeds the yield point of the latter and results in fluidizing at least in the upper region of the slug 16. The slug 16 then acts as a hydraulic fluid and transmits pressure to the side walls of the hole 12. The high viscosity of the fluid together with the small passageway around the pin 14 effectively prevents significant reduction in the pressure due to leakage. The pressure created by the deceleration of the pin 14 over a very short distance, which may be of the order of one millimeter, is transmitted as pressure against the side of the hole 12 in the region of the slug 16. Some extrusion of the slug 16 around the sides of the pin 14 will occur but because of the relatively high viscosity of the material when extruded, this escape will not significantly reduce the impact pressure transferred to the sides of the hole 12.

In most cases the impacting device (now shown) which is applied to pin 14 need develop only a relatively small velocity in the region of 2 to 5 meters per second as, for example, by a simple drop hammer. The slug 16 and pin 14 may be impacted several times until the rock fractures. Provided a sufficiently large impact is effected, the core fractures in a plane 20 transverse to the hole at its base. It may also fracture vertically but only to leave relatively large pieces of rock which can later be easily removed. By the foregoing method large cores of rock may be removed without blasting or without the difficult job of attempting to fracture the core from the annular kerf 10 with chisels and the like. If the slug 16 fits only loosely in the hole 12, it will be expanded radially following impact until it contacts the side wall of the hole 12 after which further impacting will cause the rock to fracture.

Figure 3:
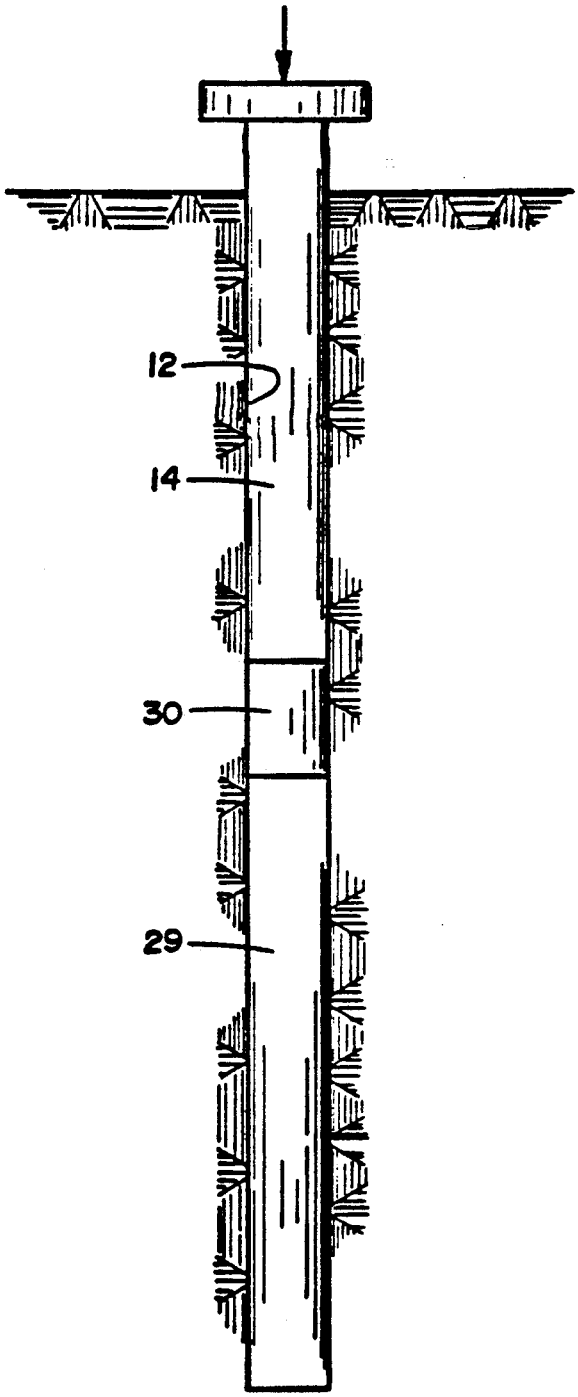
FIG. 3 is a cross-sectional view of a formation showing an impact pin and a composite slug assembly.

Referring to FIG. 3 there is shown a formation in cross section with a pin 14 inserted into a hole 12 and contacting an outer slug 30 of relatively hard but malleable material. The outer slug 30 rests on an inner slug 29 of much softer material. The outer slug 30 can be copper or aluminum while the inner slug 29 can be lead or even rubber. Impacting the pin 14 causes a transverse pressure to be created against the sides of the hole 12 along the whole of the length of slug 29. By making slug 29 long, a tendency to fracture the formation along a vertical plane will be created. The function of outer pin 30 is to seal the material of the inner slug 29 and prevent diminution of pressure through escape of material of slug 29 up the sides of the hole upon impact. The outer slug 30 upon impact has a reduced tendency to escape between the sides of the pin 14 and the hole 12 because of its higher viscosity.

Figure 4:
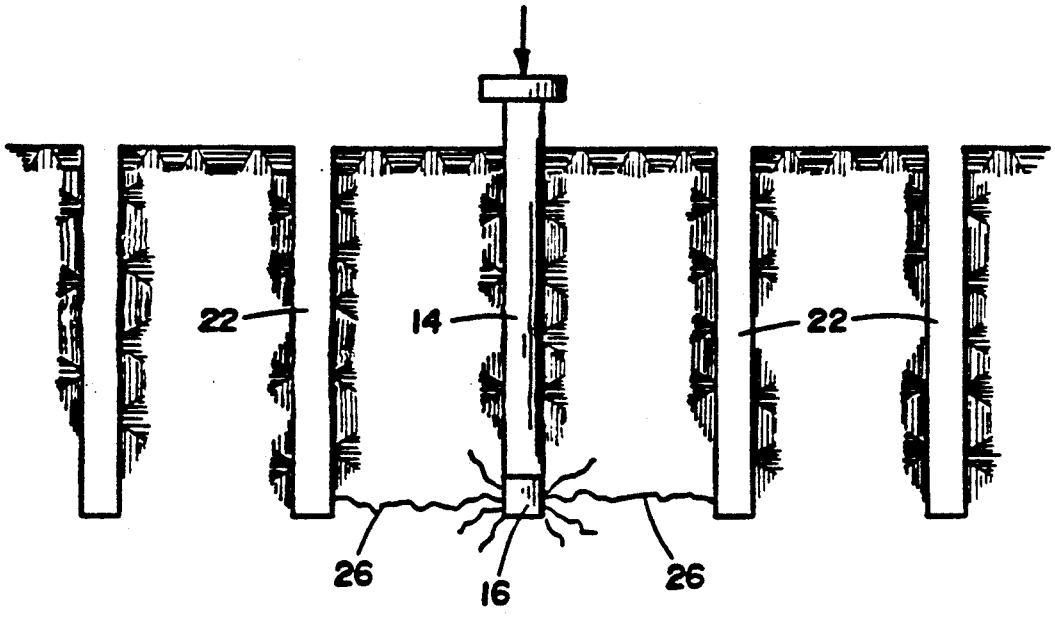
FIG. 4 is a cross-sectional view of a formation with a plurality of holes and a pin and slug in one of the holes.
Figure 5:
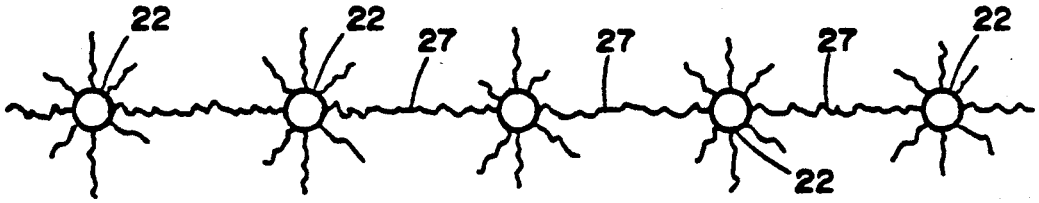
FIG. 5 is a plan view of a formation with a plurality of holes lying in a row in which a fracture in a plane joining the holes is formed by the method of a preferred embodiment of the invention.
Figure 6:
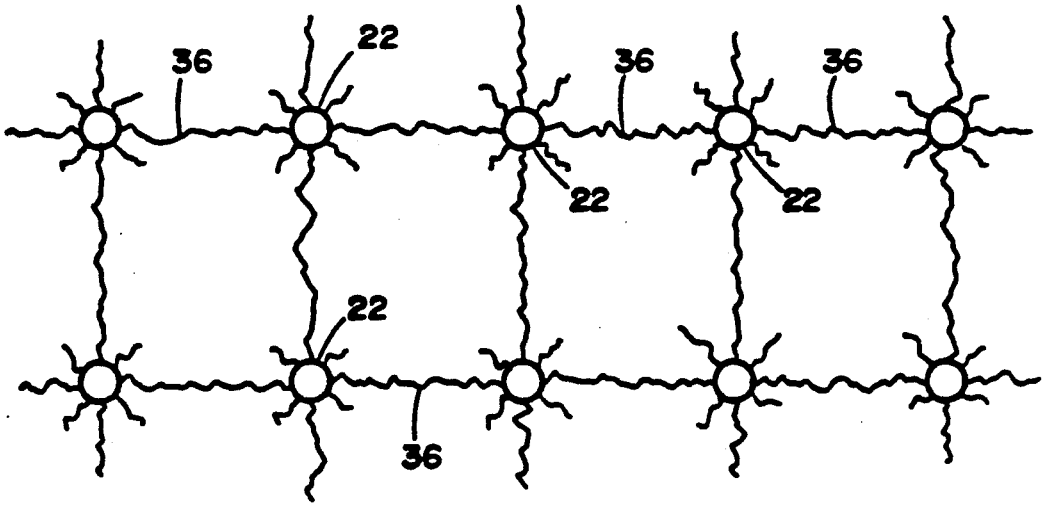
FIG. 6 is a plan view of a formation with a plurality of holes formed in an array.

Another application of the invention is shown in FIG. 4 in which an array of holes 22 are drilled in a rock formation. Next the rock is fractured using slug 16 and pin 14 in a plane transverse to the holes 22 at their base, as in FIG. 2. If the holes 22 lie in a line as in FIG. 5, and a configuration as in FIG. 3 is used, then fractures, 27 in the plane through the longitudinal axes of the holes will be created. However, if the array is as shown in FIG. 6, then a configuration with a shorter inner slug could be used to form transverse fractures 26 as in FIG. 1, intercepting nearby adjacent holes proximate the bottom thereof, as well as fractures 36 through the holes 22 in orthogonal directions. Further application of the technique in these nearby holes extends the plane of fracturing transversely until large sections of rock are loosened from the formation and can be removed.

Clearly there are many possible choices of materials for the slugs such as various plastics and harder metals such as iron and steel. The preferred choice of material depends on both the length of hole over which pressure is to be transferred and the characteristics of the material to be fractured.

Figure 7:
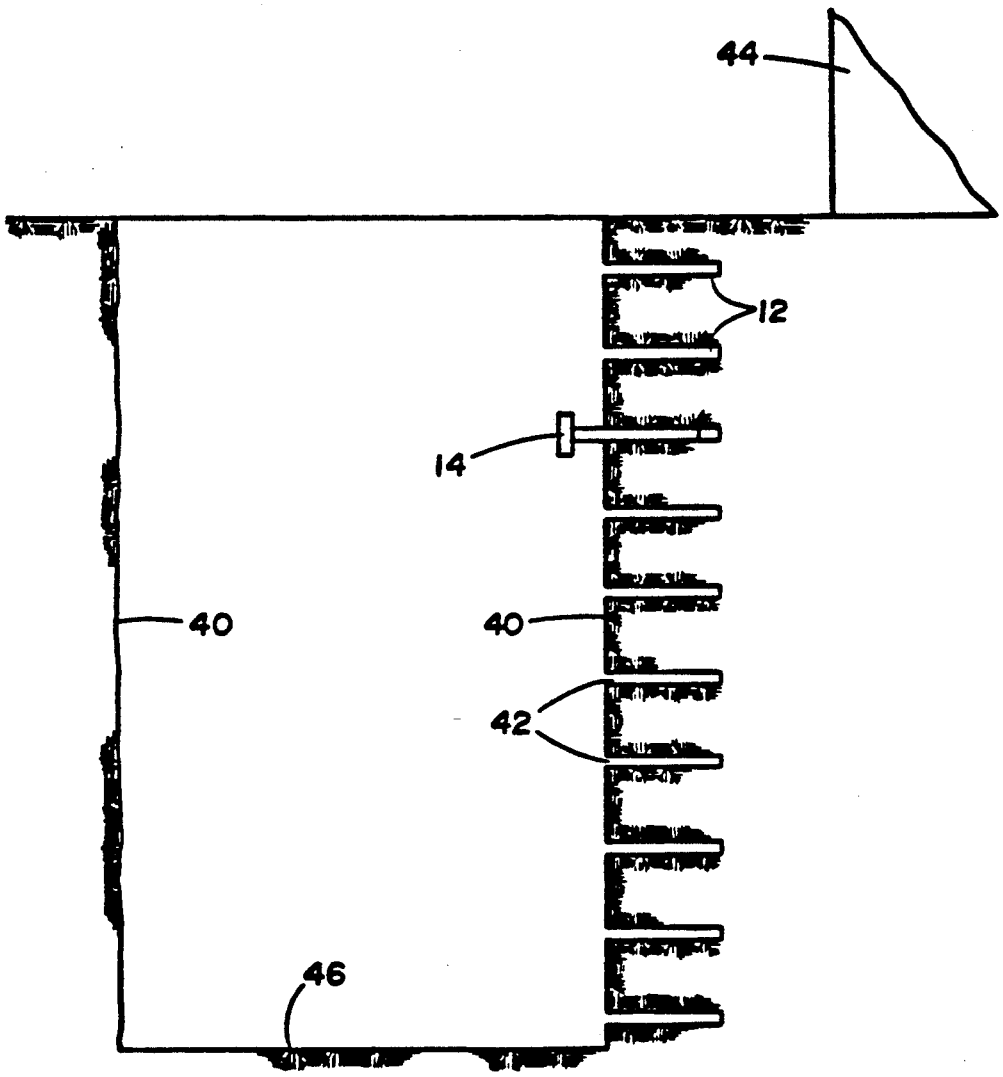
FIG. 7 cross sectional view of an excavation for a building using a preferred embodiment of the present invention.

Referring to FIG. 7, there is shown how an array of holes 42 drilled horizontally as in FIG. 6 can be used to excavate a building site adjacent a building 44 in a location where blasting is unacceptable. First a vertical excavation over a limited area is carried out down to a desired depth to bottom 46. Next the excavation is widened by drilling and impacting an array of horizontally directed holes 42 in walls 40 until the boundary of the site is reached.

Figure 8:
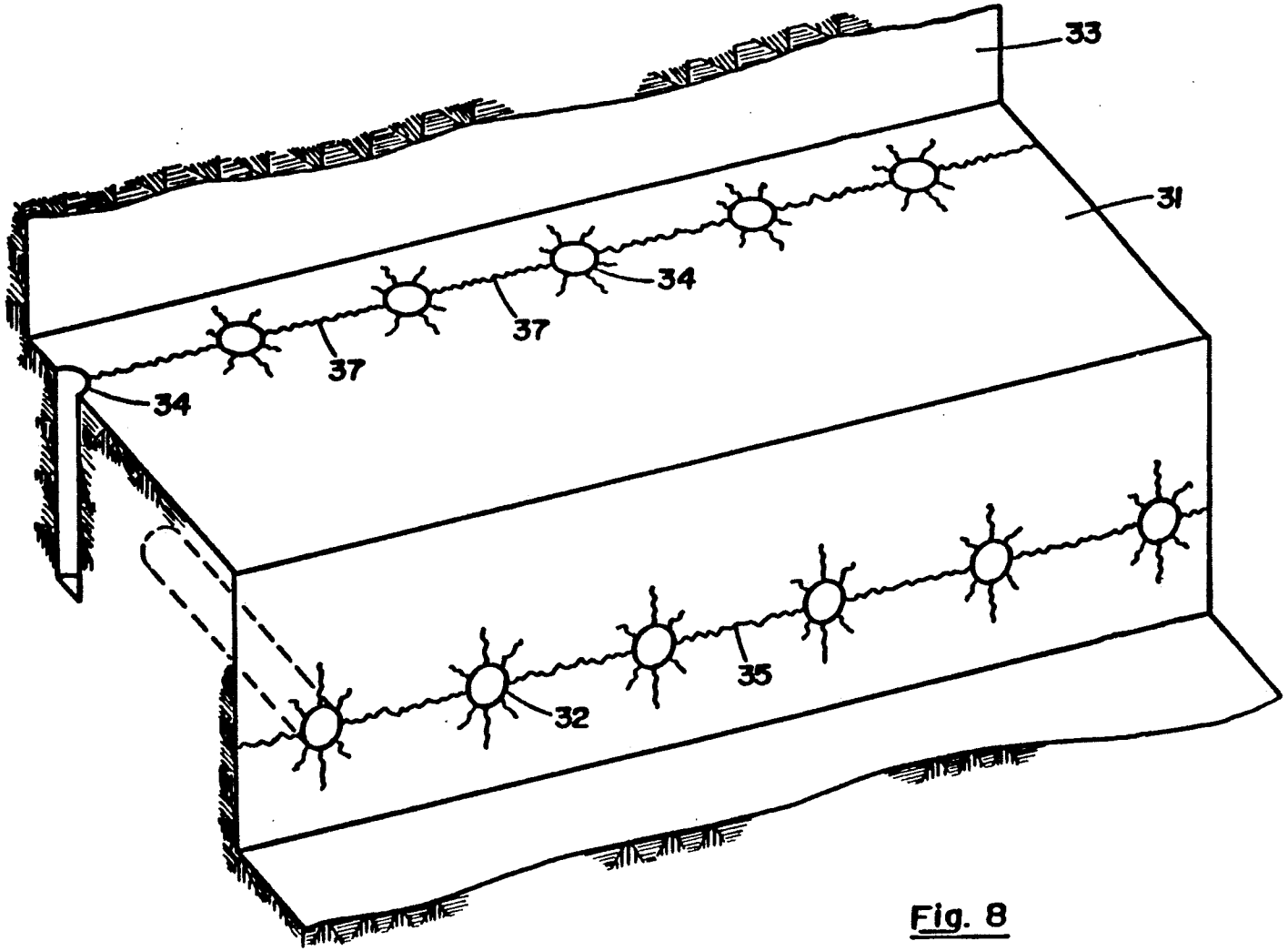
FIG. 8 is a perspective view partly in section showing fracturing and release of a slab of a material.

Another application of the invention is shown in FIG. 8 in which a parallel series of holes 34 are drilled into a bench of rock 31 formed on a rock face 33. Such a bench 31 is formed after several slabs have been removed from face 33 from the top down to the level of bench 31. A horizontal series of holes 32 are also drilled so that they pass between respective ones of holes 34 near the bottom thereof. A composite slug such as 29 and 30 shown in FIG. 3 is inserted into each of holes 32 and 34 and impacted as previously described with reference to FIG. 3. The longitudinally extended pressure transferral results in a fractures 35 and 37 not only in a plane transverse to but also along the plane passing through the set of parallel holes 32 and 34 being fractured. A resultant slab is formed which is reliably defined by the planes through the two sets of holes 32 and 34.

Figure 9:
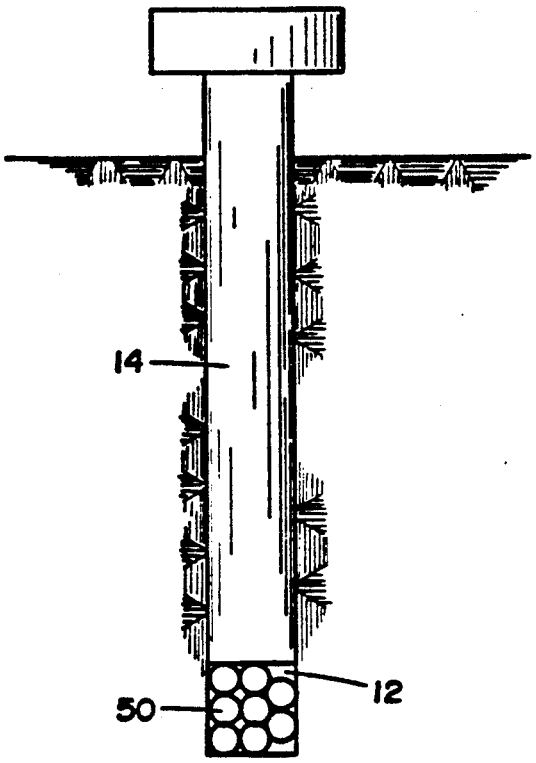
FIG. 9 is cross sectional view of a formation showing the utilization of a plurality of separate balls of material rather than a single slug in which the pin is used to compress the balls and form a slug in situ.
Figure 10:
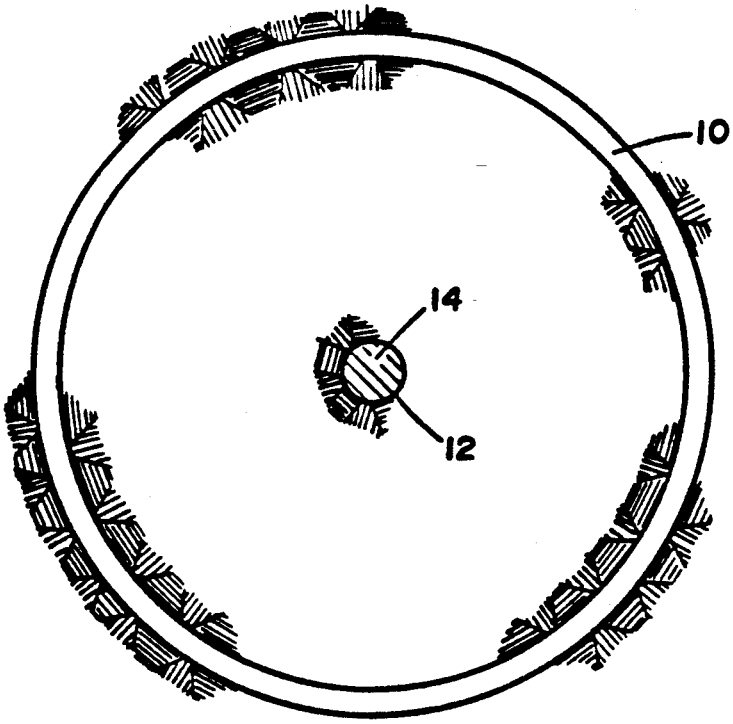
FIG. 10 is a cross-sectional view taken along line AA of FIG. 1, of a rock formation showing an annular kerf and a central hole with a slug and pin inserted into the hole.

Referring to FIG. 9 there is shown an alternative method of fracturing rock utilizing individual pieces of slug material, in this case in the form of balls 50. Pin 14 is used to compress the balls into a slug defined by the dimensions of the hole 12. Further impacting of the slug so formed results in fracturing of the rock formation.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A method of fracturing a hard compact material such as rock or concrete which has a hole pre-drilled in the area to be fractured, comprising:

inserting a slug of solid material into said hole, to a bottom thereof; and impacting said slug with a force sufficiently large to cause said slug to transfer the impact by hydraulic action to the sides and the bottom of said hole so as to fracture material surrounding said hole.

2. A method according to claim 1, wherein said hole and said slug are cylindrical.

3. A method according to claim 1, wherein the length of said slug is approximately equal to its diameter.

4. A method according to claim 1, wherein the force of impact is sufficient to exceed the yield point of the slug material and cause at least an upper portion of said

5. A method according to claim 1, including drilling an annular kerf so as to surround the hole down to a depth approximately equal to the depth of the hole prior to insertion of and impacting the top of said slug so that at least a substantial portion of a core defined by the kerf and transversely by the bottom of the hole is fractured and free of the underlying formation.

6. A method according to claim 1, wherein said slug is a malleable solid material.

7. A method according to claim 1, including a pin extending at least from an opening of said hole down to a top of said slug when fully inserted, said pin composed of a material harder than said slug and dimensioned to fit snugly in said hole.

8. A method according to claim 1, wherein said slug is in the form of pieces of material.

9. A method of fracturing a hard compact material such as rock or concrete which has a hole pre-drilled in the area to be fractured, comprising:

inserting first an inner slug and then an outer slug into said hole to a bottom thereof, wherein both slugs are of solid material and said outer slug of a harder material than said inner slug; and impacting said outer slug with a force sufficiently large to cause said inner and outer slugs to transfer the impact by hydraulic action to the sides and the bottom of said hole so as to fracture material surrounding said hole.

10. A method according to claim 9, wherein said inner and outer slugs are of a malleable solid material.

11. A method of fracturing a hard unitary material such as rock and cement, comprising:

drilling a hole in said material;

inserting a cylindrical slug of solid material into said hole;

inserting a pin into said hole which fits snugly into said hole and extends from an exterior thereof down to a top of said slug; and impacting said pin with a force sufficiently large to cause said slug to transfer the impact by hydraulic action to the sides and the bottom of said hole so as to fracture material surround said hole.

12. A method according to claim 11, including drilling an annular kerf substantially concentric with said hole prior to inserting and impacting said slug so that after impacting said slug a core of material within said kerf is fractured in at least a plane transverse to said hole between the kerf and the hole at a level of approximately a bottom of said hole.

13. A method according to claim 11 or 12, wherein said slug is cylindrical with an outer surface substantially conforming to the inner surface of the hole.

14. A method according to claim 11 or 12, wherein said slug is in the form of individual pieces which, upon impact become fused into a piece whose shape is substantially defined by the shape of said hole.

15. A method of fracturing a hard unitary material such as rock and cement, comprising:

drilling a hole in said material;

inserting first an inner cylindrical slug and then an outer cylindrical slug into said hole ,wherein said slugs are of solid material, and said inner slug is longer than said outer slug and has a substantially lower yield point than said outer slug;

inserting a pin into said hole which fits snugly into said hole and extends from an exterior thereof down to a top of said outer slug; and impacting said pin with a force sufficiently large to cause at least a top portion of said outer slug to transfer the impact by hydraulic action to the sides and the bottom of said hole so as to fracture material surrounding said hole.

16. A method of fracturing a hard unitary material such as rock and cement, comprising:

drilling a plurality of holes in said material defining a preselected pattern;

inserting a slug of solid material into each of said holes;

inserting a pin into each of said holes of a size which fits snugly into said holes and extends from an exterior thereof down to a top of said slug; and impacting said pin with a force sufficiently large to cause said slug to transfer the impact by hydraulic action to the sides and the bottom of each of said hole so as to fracture material surrounding said hole.

17. A method of fracturing a hard unitary material such as rock and cement, comprising:

drilling a plurality of holes in said material defining a preselected pattern;

inserting first an inner slug and then an outer slug into each of said holes, wherein said plugs are of solid material, said outer slug being of a material substantially harder than said inner slug;

inserting a pin into each of said holes of a size which fits snugly into said holes and extends from an exterior thereof down to a top of said slug; and impacting said pin with a force sufficiently large to cause said inner and outer slugs to transfer the impact by hydraulic action to the sides and the bottom of said hole so as to fracture material surrounding said hole.

18. A method according to claim 17, wherein said pattern is a first set of vertically directed ones of said plurality of holes forming a straight line and a second set horizontally directed ones of said plurality of holes forming a straight line and terminating proximate bottoms of said first set of holes so that the following impact said material is fractured in a vertical plane through said vertically directed holes and horizontally through said horizontally directed holes.

19. Apparatus for fracturing a hard unitary material such as rock and cement, having a hole formed in an area of the material to be broken, comprising:

a slug of solid material having an outer surface conforming to the inner surface of the hole; and means for impacting said slug when inserted into said hole at a bottom thereof so as to impart by hydraulic action the force of the impact upon the sides and the bottom of said hole.

20. The apparatus according to claim 19, wherein said impacting means includes an elongated pin of material harder than said slug and extending from a top of said slug to a point exterior of said hole.

21. Apparatus according to claim 19, wherein the material of said slug is a solid malleable material.

22. Apparatus for fracturing a hard compact material such as rock and cement, comprising:

a drill having a central drill bit and an annular drill bit for forming a central hole and an annular kerf concentric with said hole down to approximately the said depth as said hole;

malleable material capable of being fused upon impact so as to conform to the interior surface of a hole drilled by said central hole drill bit;

an elongated pin of substantially the same diameter as said central drill bit and extending from a top of said material, when placed at a bottom of the central hole, to a point exterior to the hole; and means for impacting said pin with sufficient force so as to exceed the yield point of said material and transfer impact pressure to the side of said hole so as to fracture said material.

* * * * *